US009376284B2

(12) United States Patent
Komuro

(10) Patent No.: US 9,376,284 B2
(45) Date of Patent: Jun. 28, 2016

(54) MEDIUM RECEIVING CASSETTE AND RECORDING APPARATUS

(71) Applicant: SEIKO EPSON CORPORATION, Tokyo (JP)

(72) Inventor: Shintaro Komuro, Shiojiri (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

(21) Appl. No.: 14/259,025

(22) Filed: Apr. 22, 2014

(65) Prior Publication Data

US 2014/0319768 A1 Oct. 30, 2014

(30) Foreign Application Priority Data

Apr. 24, 2013 (JP) ..... 2013-091041

(51) Int. Cl.
*B65H 31/02* (2006.01)

(52) U.S. Cl.
CPC ..... *B65H 31/02* (2013.01); *B65H 2301/4212* (2013.01); *B65H 2405/11151* (2013.01); *B65H 2405/11162* (2013.01); *B65H 2405/111646* (2013.01); *B65H 2405/31* (2013.01); *B65H 2405/324* (2013.01); *B65H 2405/3322* (2013.01); *B65H 2801/12* (2013.01)

(58) Field of Classification Search
CPC ..... B65H 1/00; B65H 1/027; B65H 31/00; B65H 31/20; B65H 1/04
See application file for complete search history.

(56) References Cited

U.S. PATENT DOCUMENTS

| | | | | |
|---|---|---|---|---|
| 4,583,872 | A * | 4/1986 | Chu et al. | 400/625 |
| 6,053,493 | A * | 4/2000 | Yokoyama et al. | 271/171 |
| 6,106,178 | A * | 8/2000 | Chiu | B41J 13/103 400/624 |
| 6,382,617 | B1 * | 5/2002 | Yen | B41J 13/103 271/126 |
| 7,277,199 | B2 * | 10/2007 | Swayze et al. | 358/1.9 |
| 7,481,425 | B2 * | 1/2009 | Chikumoto | 271/164 |
| 7,694,951 | B2 * | 4/2010 | Shiohara | 271/9.08 |
| 7,878,500 | B2 * | 2/2011 | Wakakusa | 271/162 |
| 8,297,614 | B2 * | 10/2012 | Takeuchi et al. | 271/162 |
| 2005/0207783 | A1 | 9/2005 | Sugimura et al. | |
| 2006/0261535 | A1 | 11/2006 | Shiohara et al. | |
| 2007/0075477 | A1 | 4/2007 | Shiohara | |
| 2014/0319760 | A1 * | 10/2014 | Komuro | B65H 31/20 271/223 |
| 2014/0319761 | A1 * | 10/2014 | Komuro | B65H 31/20 271/223 |

FOREIGN PATENT DOCUMENTS

| | | |
|---|---|---|
| CN | 1673880 | 9/2005 |
| JP | 2006-273565 | 10/2006 |
| JP | 2007-091445 | 4/2007 |

* cited by examiner

*Primary Examiner* — Ernesto Suarez
(74) *Attorney, Agent, or Firm* — Workman Nydegger

(57) ABSTRACT

Provided is a medium receiving cassette that includes a medium receiving portion in which a medium is received, and a medium support tray which is pivotally provided on the medium receiving portion and of which a state can be switched, in a pivoting manner, between a received state in which the medium support tray is positioned above the medium receiving portion and a medium support surface for supporting the medium is directed downward and an expanded state in which the medium support surface is directed upward and at least a part of the medium support surface is expanded outside the medium receiving portion.

3 Claims, 9 Drawing Sheets

MEDIUM RECEIVING CASSETTE AND RECORDING APPARATUS

BACKGROUND

1. Technical Field

The present invention relates to a medium receiving cassette which is attachable/detachable to/from a main body of a recording apparatus which performs recording on a medium. Furthermore, the invention relates to a recording apparatus equipped with the medium receiving cassette.

2. Related Art

In recent years, a paper sheet cassette which is attachable/detachable to/from an apparatus main body has been widely used for a recording apparatus, such as a facsimile and a printer. A paper sheet cassette which is attachable/detachable to/from an apparatus and which has a two-stage structure constituted by a lower paper sheet receiving portion and an upper paper sheet receiving portion has been known, for example, a structure disclosed in JP-A-2006-273565 or JP-A-2007-91445 of the related art.

The paper sheet cassette disclosed in JP-A-2006-273565 or JP-A-2007-91445 has a configuration in which a second paper feeding cassette on an upper-stage also functions as a discharged paper receiving portion for receiving a paper sheet on which recording is performed. In other words, the second paper feeding cassette is configured such that a user switches a position of the second paper feeding cassette between a retreated position to which the second paper feeding cassette retreats not to be obstructive when paper sheets are fed from a first paper feeding cassette located below the second paper feeding cassette and an advanced position to which the second paper feeding cassette is advanced to feed the paper sheets. Particularly, when the second paper feeding cassette is located at the retreated position, a relatively large paper sheet which is fed from the first paper feeding cassette and on which recording is performed can be received by the discharged paper receiving portion which is formed integrally with the second paper feeding cassette.

In a case where a discharged paper receiving portion is configured to be provided in a paper sheet cassette, as described above, it is not necessary to provide a supporting structure for supporting the discharged paper receiving portion, to a main body side of the recording apparatus. Thus, there is an advantage in that a reduction in costs can be achieved. However, there are also disadvantages as described below.

That is, it is preferable that a support surface of the discharged paper receiving portion, which supports the paper sheet, form an inclined surface of which a front edge is directed upward to prevent the discharged paper sheet from slipping off. However, in a case where the discharged paper receiving portion is configured to be provided in the paper sheet cassette, as in the related art described above, when the support surface for supporting the paper sheet is inclined upward, the entire height of the paper sheet cassette increases. As a result, a height of a recording apparatus main body to which the paper sheet cassette is mounted also increases.

SUMMARY

An advantage of some aspects of the invention is to provide a paper sheet cassette which has a support tray for supporting a discharged paper sheet while suppressing a height of the paper sheet cassette.

According to an aspect of the invention, there is provided a medium receiving cassette that includes a medium receiving portion in which a medium is received, and a medium support tray which is pivotally provided on the medium receiving portion and of which a state can be switched, in a pivoting manner, between a received state in which the medium support tray is positioned above the medium receiving portion and a medium support surface for supporting the medium is directed downward and an expanded state in which the medium support surface is directed upward and at least a part of the medium support surface is expanded outside the medium receiving portion.

In this case, the state of the medium support tray provided on the medium receiving cassette can be switched, in a pivoting manner, between the received state in which the medium support tray is positioned above the medium receiving portion and the medium support surface for supporting the medium is directed downward and the expanded state in which the medium support surface is directed upward and at least a part of the medium support surface is expanded outside the medium receiving portion. Thus, the medium support tray can take a different posture when the state of the medium support tray is switched between the received state and the expanded state. Therefore, a height (a size in a medium stacking direction) of the medium receiving cassette can be suppressed in the received state. Furthermore, appropriate posture of the medium support tray in the expanded state can be ensured.

In the medium receiving cassette, when the medium support tray is in the expanded state, the medium support surface may form a surface inclined obliquely upward toward a front edge of the medium support tray.

In this case, the medium which is discharged from an upper side of the medium support tray and supported by the medium support surface can be prevented from slipping off the medium support tray because, when the medium support tray is in the expanded state, the medium support surface forms a surface inclined obliquely upward toward a front edge of the medium support tray. Therefore, the paper sheet can be appropriately supported.

In the medium receiving cassette, the medium support tray may include a tray main body portion which forms the medium support surface and arm portions which are provided on both end portions of the tray main body portion in the pivot-axis direction of the medium support tray and extend from the tray main body portion toward pivot centers of the medium support tray and which are pivotally connected to the medium receiving portion and form the pivot centers of the medium support tray.

In this case, the tray main body portion of the medium support tray is pivotally mounted to the medium receiving portion via the arm portions which form the pivot centers. In other words, when the medium support tray is in the expanded state, the tray main body portion can be located at the position spaced apart from the pivot centers. Accordingly, when the medium support tray is in the expanded state, an upper portion of the medium receiving portion can be opened in wide manner, and thus workability is improved when the medium receiving portion is filled with media.

According to another aspect of the invention, there is provided a recording apparatus that includes a recording head which performs recording on a medium and the medium receiving cassette according to an aspect which is attachable/detachable to/from an apparatus main body equipped with the recording head, in which the medium which is discharged from the apparatus main body and on which recording is performed is supported by the medium support tray in the expanded state.

In this case, the recording apparatus which performs recording on the medium can achieve the same operational effects as those in the aspects.

According to still another aspect of the invention, there is provided a recording apparatus that includes a recording head which performs recording on a medium, a medium receiving portion in which the medium is received, and a medium support tray which is pivotally provided on the medium receiving portion and supports the discharged medium on which recording is performed and of which a state can be switched, in a pivoting manner, between a received state in which the medium support tray is positioned above the medium receiving portion and a medium support surface for supporting the medium is directed downward and an expanded state in which the medium support surface is directed upward and at least a part of the medium support surface is expanded outside the medium receiving portion.

In this case, the state of the medium support tray which is provided in the recording apparatus can be switched, in a pivoting manner, between the received state in which the medium support tray is positioned above the medium receiving portion and the medium support surface for supporting the medium is directed downward and the expanded state in which the medium support surface is directed upward and at least a part of the medium support surface is expanded outside the medium receiving portion. Thus, the medium support tray can take a different posture when the state of the medium support tray is switched between the received state and the expanded state. As a result, a height (a size in a medium stacking direction) of the medium receiving cassette can be suppressed in the received state. Furthermore, appropriate posture of the medium support tray in the expanded state can be ensured.

In the recording apparatus, when the medium receiving portion is in a mounted state, the medium receiving portion may protrude from one side surface of an apparatus main body having the recording head, which constitutes a periphery of the apparatus main body, and an opening portion may be formed between a part of the medium receiving portion, which protrudes from the one side surface, and the medium support tray.

In this case, the opening portion is formed between the medium receiving portion and the medium support tray, and thus presence or absence of media in the medium receiving portion can be easily confirmed through the opening portion.

The recording apparatus may further include a discharging roller for discharging a medium and an intermediate guiding member which is provided between the discharging roller and the medium support tray and which forms a guiding surface for guiding the medium to the medium support tray.

In this case, the intermediate guiding member which is provided between the discharging roller for discharging the medium and the medium support tray and which forms the guiding surface for guiding the medium to the medium support tray is further provided, and thus the discharged medium is smoothly supported by the medium support tray.

In the recording apparatus, the intermediate guiding member may also function as a cover which covers the opening portion.

In this case, the intermediate guiding member also functions as the cover which covers the opening portion, and thus foreign matter can be prevented from entering into the opening portion. In addition, the intermediate guiding member also functions as the cover, and thus it is possible to suppress an increase in costs.

In the recording apparatus, the intermediate guiding member may be pivotally mounted, and a posture of the intermediate guiding member may be changed in accordance with a posture of the medium support tray.

In this case, the intermediate guiding member is pivotally mounted, and the posture of the intermediate guiding member can be changed in accordance with the posture of the medium support tray. Therefore, it is possible to more smoothly guide the discharged medium to the medium support tray.

BRIEF DESCRIPTION OF THE DRAWINGS

The invention will be described with reference to the accompanying drawings, wherein like numbers reference like elements.

DESCRIPTION OF EXEMPLARY EMBODIMENTS

Hereinafter, an embodiment of the invention will be described with reference to the accompanying drawings.

Figure 1:
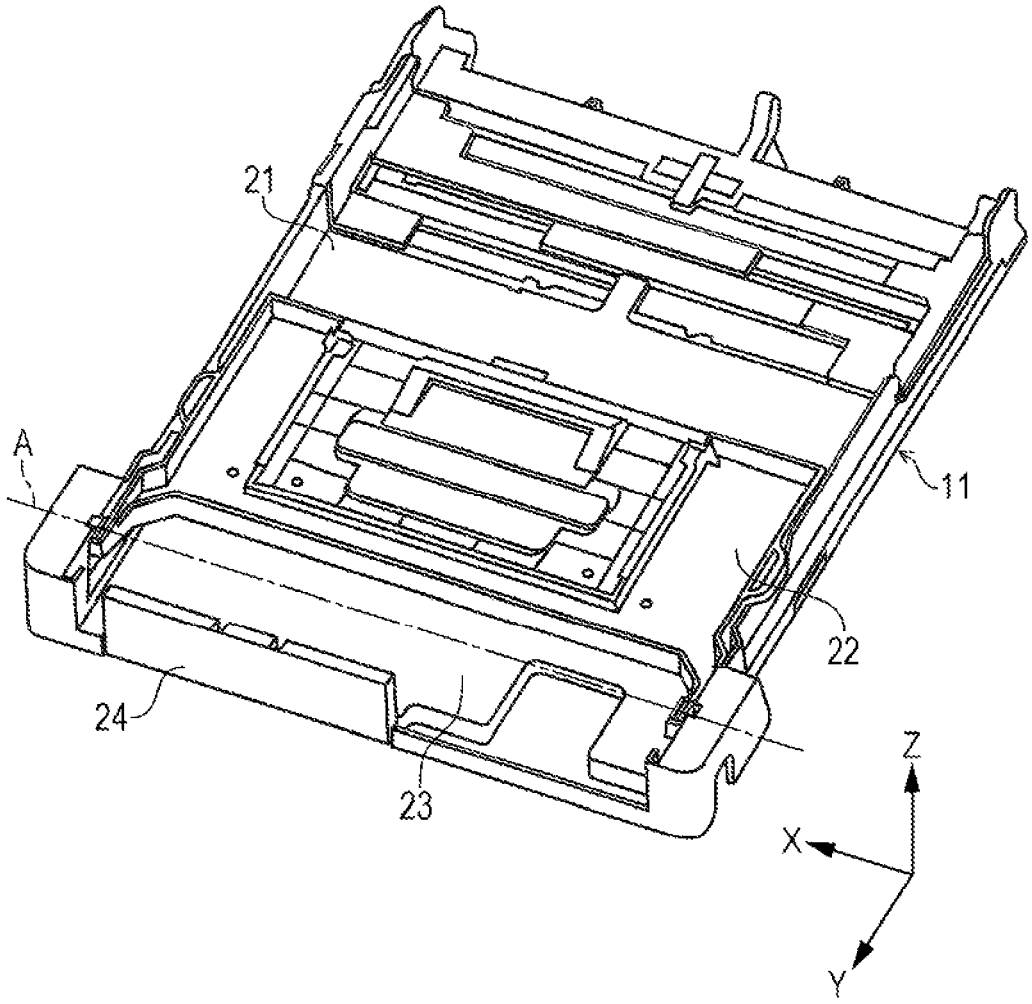
FIG. 1 is a perspective view illustrating an external appearance of a paper feeding cassette according to the invention.
Figure 2:
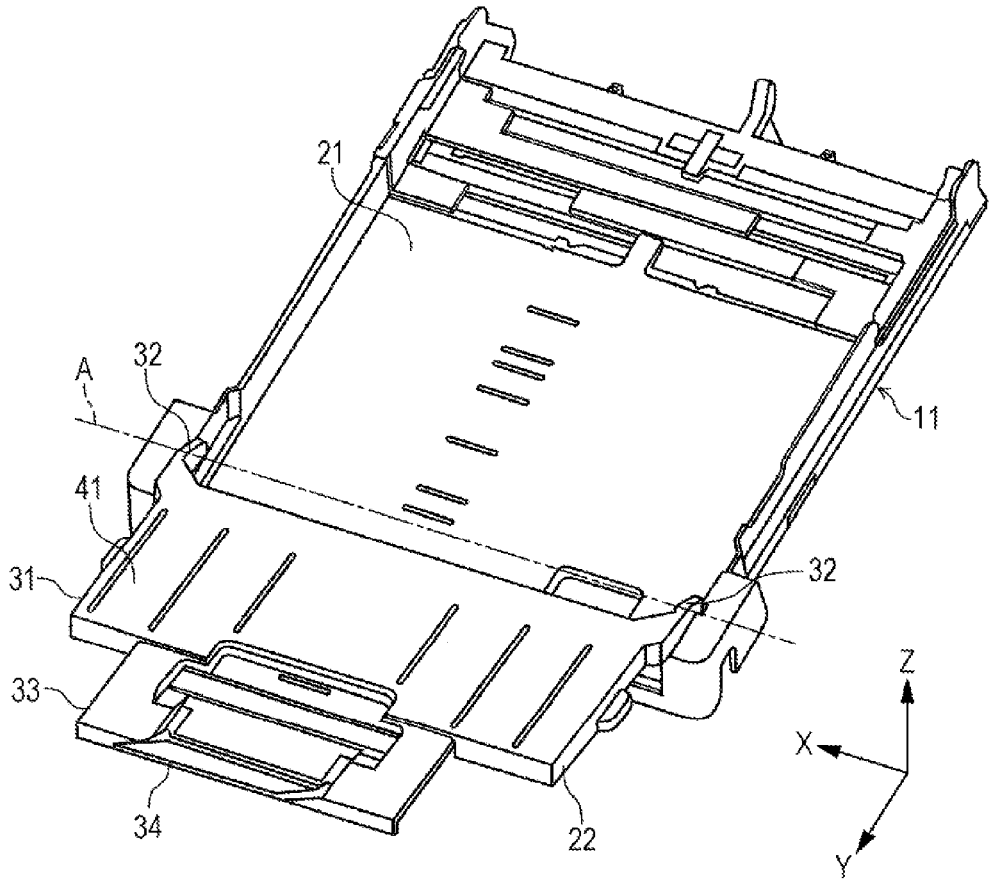
FIG. 2 is a perspective view illustrating an external appearance of the paper feeding cassette according to the invention.

FIGS. 1 and 2 are perspective views illustrating an external appearance of a paper feeding cassette 11 according to an example of the embodiment of the invention. FIG. 1 is a perspective view illustrating the external appearance of the paper feeding cassette 11 in a received state. The received state is a state in which a stacker 22 is received in the paper feeding cassette 11. FIG. 2 is a perspective view illustrating the external appearance of the paper feeding cassette 11 in an expanded state. The expanded state is a state in which the stacker 22 is expanded.

In the following description, a front-rear direction of the paper feeding cassette 11 is set to a Y axis, an up-down direction thereof is set to a Z axis, and a right-left direction is set to an X axis. Further, in the following description, a left side in FIG. 1, in terms of the X-axis direction, is simply referred to as a left side and a right side in FIG. 1, in terms of an X-axis direction, is simply referred to as a right side. In addition, in the following description, a front side in FIG. 1, in terms of a Y-axis direction, is simply referred to as a front side and a back side in FIG. 1, in terms of the Y-axis direction, is simply referred to as a rear side. In addition, in the following description, an upper side in FIG. 1, in terms of a Z-axis direction, is simply referred to as an upper side and a lower side in FIG. 1, in terms of the Z-axis direction, is simply referred to as a lower side.

The paper feeding cassette 11 is an example of a medium receiving cassette which is attachably/detachably mounted to a main body of a recording apparatus that performs recording on a medium. Paper sheets as an example of media are received in the paper feeding cassette 11.

The paper feeding cassette 11 includes a receiving portion 21, the stacker 22, and a drawer portion 24. In a front side of the paper feeding cassette 11, an opening portion 23 is formed between the receiving portion 21 and the stacker 22. The receiving portion 21 is an example of a medium receiving portion and receives paper sheets which are stacked up in the Z-axis direction. The paper feeding cassette 11 is mounted to a printer 51 (see FIG. 4, described below) as an example of a recording apparatus. When the printer 51 performs printing on the paper sheets, the printer 51 causes the received paper sheet to be fed from the receiving portion 21 and to be transferred. Then the printer 51 performs recording on the paper sheet. Furthermore, the paper feeding cassette 11 is mounted to the printer 51 and supports the recorded paper sheet when the printer 51 performs recording on the paper sheet.

The stacker 22 is an example of a medium support tray. In a case where the paper feeding cassette 11 is mounted on the printer 51 and the printer 51 performs recording on the paper sheet, the stacker 22 supports the recorded and discharged paper sheet. A tray main body portion 31, arm portions 32, a drawer tray 33, and an expansion tray 34 are provided in the stacker 22. The tray main body portion 31 is an example of a tray main body portion and pivotally mounted to the receiving portion 21. A support surface 41 as an example of a medium support surface is formed on one surface of the tray main body portion 31.

A state of the stacker 22 can be switched between a received state (see FIG. 1) and an expanded state (see FIG. 2). When the stacker 22 is in the received state, the stacker 22 is positioned above the receiving portion 21. Furthermore, when the stacker 22 is in the received state, the support surface 41 which supports the paper sheet is directed downward. When the stacker 22 is in the expanded state, the support surface 41 is directed upward and expanded outside the receiving portion 21.

The state of the stacker 22 can be switched between the received state and the expanded state, and thus the stacker 22 can take a different posture (that is, the support surface 41 can be positioned at different angles) when the state of the stacker 22 is switched between the received state and the expanded state. Therefore, the support surface 41 in the received state becomes parallel to a bottom surface of the receiving portion 21, and thus a height (a size in a medium stacking direction) of the paper feeding cassette 11 can be suppressed in the received state. Furthermore, appropriate posture (in which the support surface 41 is inclined upward) of the stacker 22 in the expanded state can be ensured.

In other words, when the stacker 22 is in the expanded state, a Z-axis position of the support surface 41 gradually changes to be directed upward as a Y-axis position of the support surface 41 changes forward. That is, when the stacker 22 is in the expanded state, the support surface 41 forms a surface inclined obliquely upward toward a front edge of the stacker 22. Accordingly, the paper sheet which is discharged from an upper side of the stacker 22 and supported by the support surface 41 can be prevented from slipping off the stacker 22. Therefore, the paper sheet can be appropriately supported.

When the state of the stacker 22 is switched from the received state to the expanded state or switched from the expanded state to the received state, the stacker 22 is pivoted on the arm portions 32 by a user. The user is not limited to an end user but includes all people operating the paper feeding cassette 11, such as a person who assembles the recording apparatus including the paper feeding cassette 11 and a person who performs customer service.

The arm portion 32 is an example of an arm portion and is pivotally connected to the receiving portion 21 to form a pivot center of the stacker 22. For example, protrusions having cylindrical-shapes are formed on a left side of the left arm portion 32 and on a right side of the right arm portion 32, and concave portions having a shape corresponding to the protrusions of the arm portions 32 are formed on the receiving portion 21. The protrusions are respectively inserted in to the concave portions, and thus the arm portions 32 can pivot with respect to the receiving portion 21.

Figure 3:
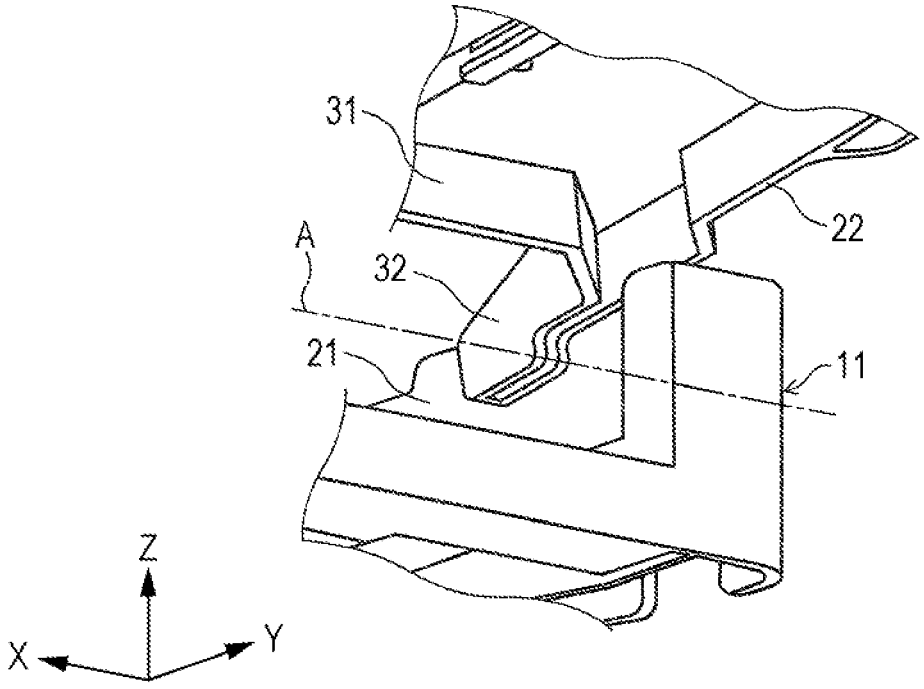
FIG. 3 is an enlarged view illustrating a right side arm portion.

FIG. 3 is an enlarged view illustrating the right side arm portion 32. Line A illustrated in FIGS. 1 to 3 shows a pivot axis line which is a pivot center axis of the stacker 22. The arm portions 32 are provided on both end portions of the tray main body portion 31 in the pivot-axis direction of the stacker 22. Each arm portion 32 is formed to extend from the tray main body portion 31 to the pivot center of the stacker 22.

As described above, the tray main body portion 31 of the stacker 22 is pivotally mounted to the receiving portion 21 via the arm portions 32 which form the pivot centers. That is, when the stacker 22 is in the expanded state, the tray main body portion 31 can be located at a position spaced apart from the pivot center. In other words, when the stacker 22 is in the expanded state, the tray main body portion 31 can be located at a position spaced apart from the receiving portion 21. Thus, when the stacker 22 is in the expanded state, an upper portion of the receiving portion 21 can be opened in wide manner. As a result, workability is improved when the receiving portion 21 is filled with paper sheets.

The drawer tray 33 can be received in the tray main body portion 31 or can be drawn out from the tray main body portion 31. When the drawer tray 33 is received in the tray main body portion 31, a front edge of the drawer tray 33 is aligned with a front edge (a front edge of an end portion opposite an end portion in which the arm portion 32 is provided) of the tray main body portion 31. In addition, when the stacker 22 is in the expanded state and the drawer tray 33 is drawn out from the tray main body portion 31, the drawer tray 33 expands the support surface 41 to a front edge side of the tray main body portion 31.

The expansion tray 34 is pivotally mounted to the front edge of the drawer tray 33. The expansion tray 34 can be received in the drawer tray 33 or can be expanded from the drawer tray 33. When the expansion tray 34 is received in the drawer tray 33, the expansion tray 34 is accommodated in a concave portion which is formed in the drawer tray 33 and of which the shape corresponds to the expansion tray 34. Accordingly, the expansion tray 34 does not obstruct receiving of the drawer tray 33 in the tray main body portion 31 or drawing-out of the drawer tray 33 from the tray main body portion 31.

In a state where the stacker 22 is expanded and the drawer tray 33 is drawn out from the tray main body portion 31, when the expansion tray 34 is expanded from the drawer tray 33, the expansion tray 34 forms a surface which is inclined further upward from the front edge of the drawer tray 33 which forms an surface inclined obliquely upward. In other words, the expansion tray 34 forms a surface inclined obliquely upward at angles greater than the angles of an inclined surface of the drawer tray 33, with respect to the drawer tray 33 which forms a surface inclined obliquely upward at the predetermined angles, relative to a horizontal plane formed by the X axis and the Y axis. As a result, the paper sheet which is discharged from the upper side of the stacker 22 and supported by the support surface 41 is prevented from slipping off from the front edge of the tray main body portion 31. Therefore, the paper sheet can be supported appropriately.

The drawer portion 24 constitutes a front-side (a paper-sheet discharging direction side: +Y side) wall surface of the receiving portion 21. The drawer portion 24 is provided on a front side of the paper feeding cassette 11 and can be drawn forward from the receiving portion 21. When a paper sheet having a length longer than a length (a length in the Y-axis direction) of the paper feeding cassette 11 is received in the paper feeding cassette 11, the drawer portion 24 is drawn forward from the receiving portion 21. In the front side of the paper feeding cassette 11, the opening portion 23 is formed between the receiving portion 21 and the stacker 22. Thus, presence or absence of the paper sheet in the paper feeding cassette 11 can be easily confirmed through the opening portion 23.

In addition, a length (a length in the X direction) of the drawer portion 24 in a paper sheet width direction is shorter than a length of the receiving portion 21 in the paper sheet width direction. Thus, a space 25 (see FIG. 4) through which a user's finger can be inserted into is formed on a lateral side of the drawer portion 24. Therefore, it is possible to place user's finger on the drawer portion 24 regardless of the state of the stacker 22, and thus it is possible to easily slide the drawer portion 24. In addition, even in a case where the paper feeding cassette 11 is mounted to the printer main body, it is possible to easily confirm presence or absence of the paper sheet in the paper feeding cassette or a paper residual quantity in the paper feeding cassette, through the space 25 which is formed on the lateral side of the drawer portion 24.

Furthermore, the drawer portion 24 is disposed (on a left side in the drawing, in this embodiment) at a position shifted from a center of the receiving portion 21 in a paper-sheet width direction. Thus, the space 25 can be formed in wide manner on the lateral side of the drawer portion 24. Accordingly, it is possible to more easily operate the drawer portion 24.

Furthermore, the drawer portion 24 is provided to allow a paper sheet having a larger size to be received in the receiving portion 21, and thus an inner wall of the receiving portion 21 may not be provided. For example, any configuration can be applied as long as it can function as an edge guide for supporting a trailing edge of the paper sheet.

Figure 4:
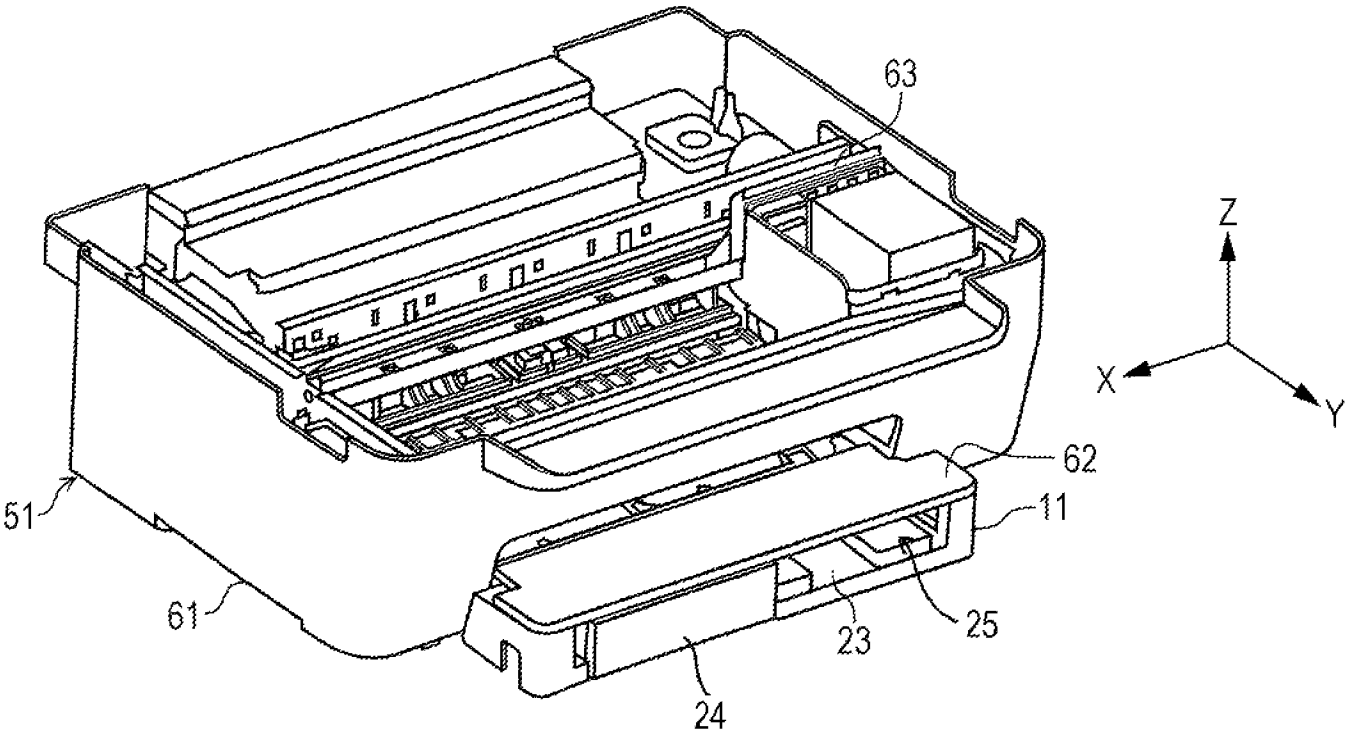
FIG. 4 is a perspective view illustrating a cross-sectional surface and an external appearance of an upper side of a printer according to the invention.
Figure 5:
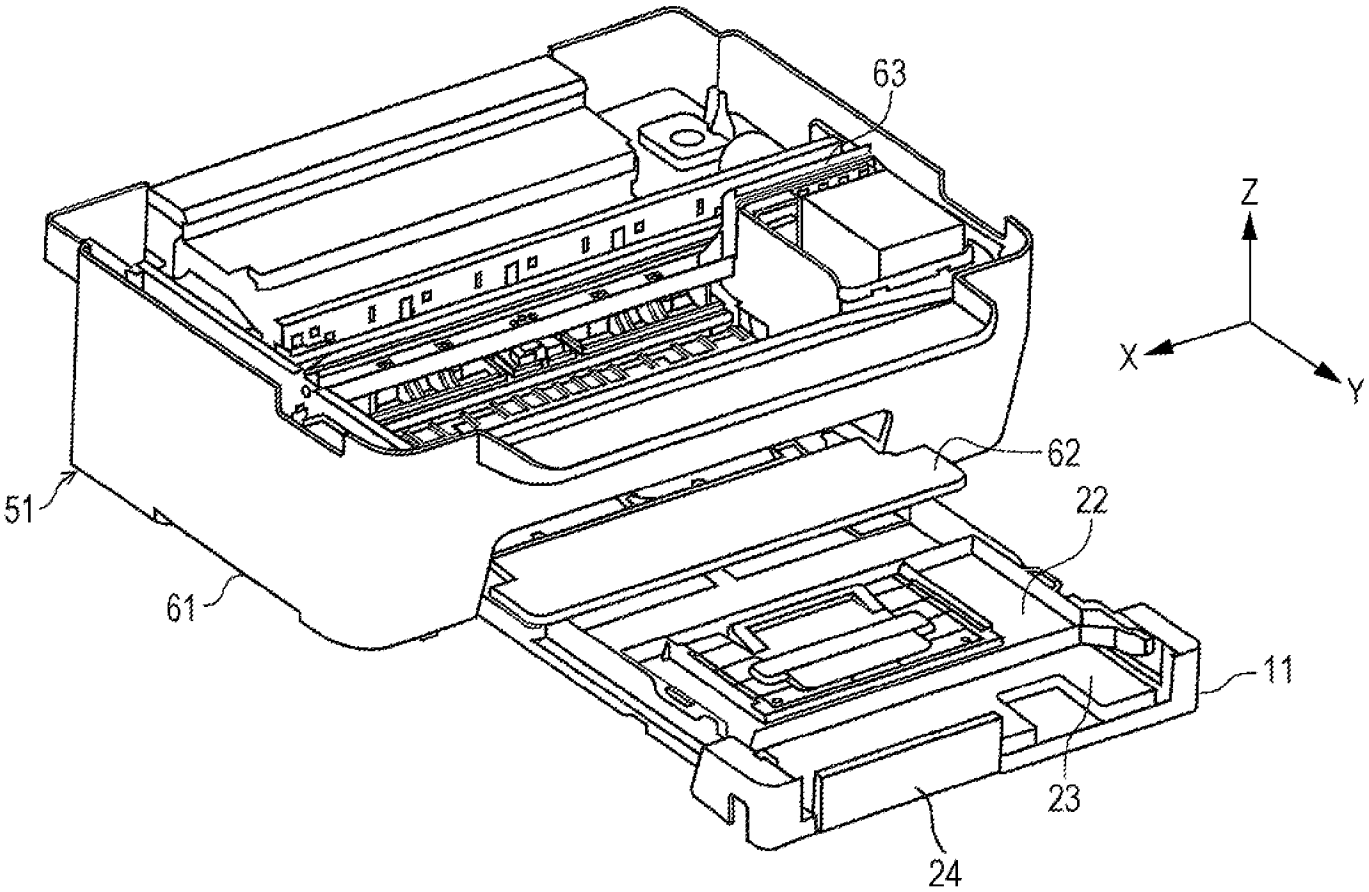
FIG. 5 is a perspective view illustrating a cross-sectional surface and an external appearance of the upper side of the printer according to the invention.
Figure 6:
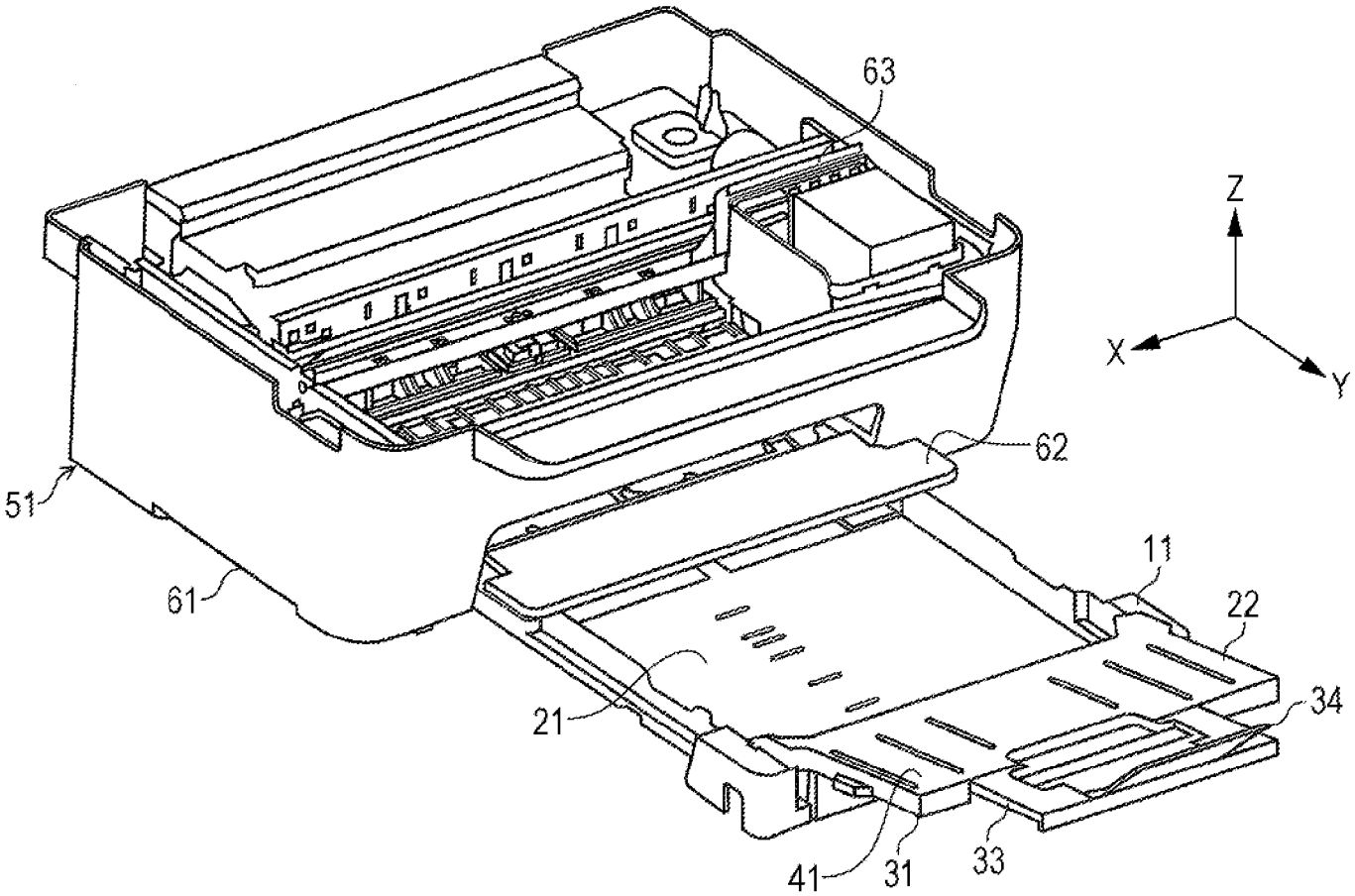
FIG. 6 is a perspective view illustrating a cross-sectional surface and an external appearance of the upper side of the printer according to the invention.
Figure 7:
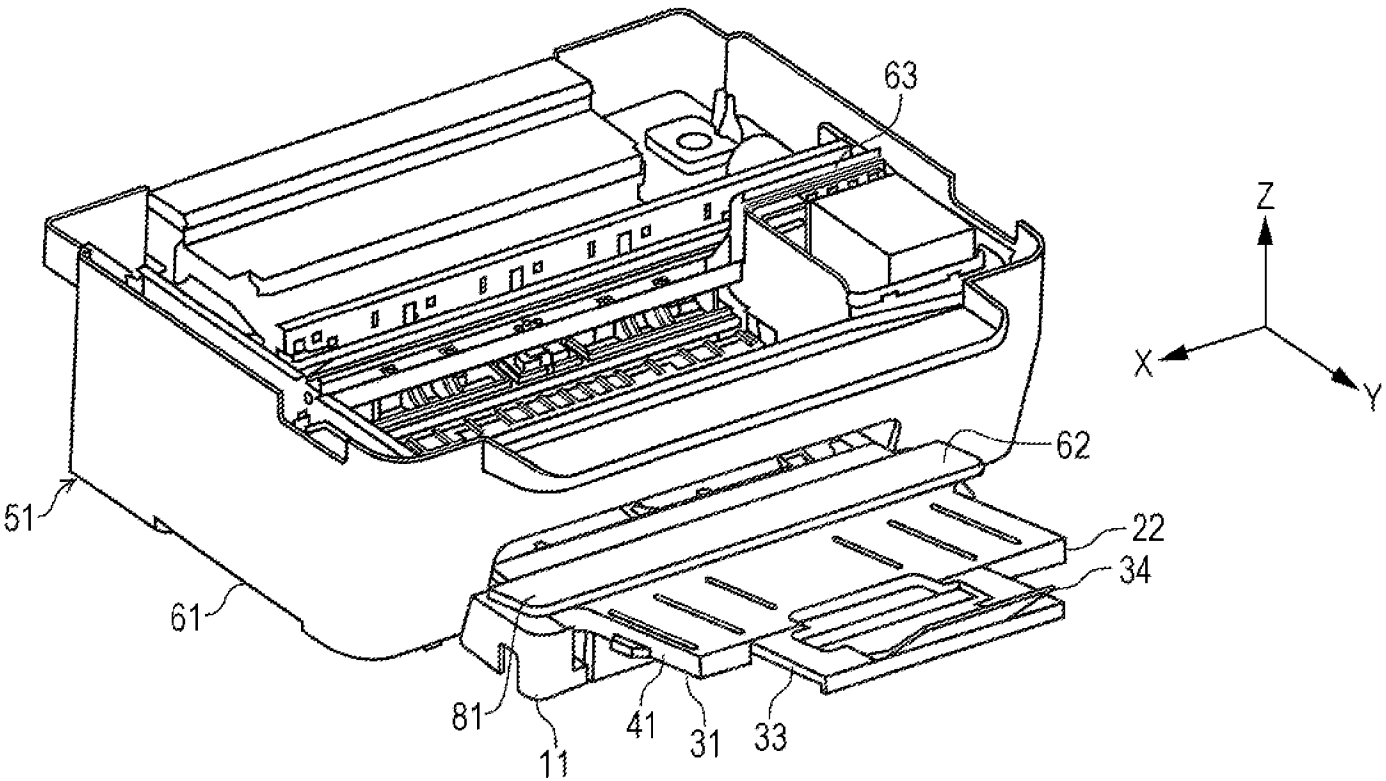
FIG. 7 is a perspective view illustrating a cross-sectional surface and an external appearance of the upper side of the printer according to the invention.

FIGS. 4 to 7 are perspective views illustrating cross-sectional surfaces and external appearances of the upper side of the printer 51 which has the paper feeding cassette 11. FIG. 4 is the perspective view illustrating the cross-sectional surface and the external appearance of the upper side of the printer 51 in which the drawn paper feeding cassette 11 in the received state is mounted. FIG. 5 is the perspective view illustrating the cross-sectional surface and the external appearance of the upper side of the printer 51 in which the paper feeding cassette 11 in the received state is drawn out. FIG. 6 is the perspective view illustrating the cross-sectional surface and the external appearance of the upper side of the printer 51 in which the paper feeding cassette 11 is in the expanded state. FIG. 7 is the perspective view illustrating the cross-sectional surface and the external appearance of the upper side of the printer 51 in which the paper feeding cassette 11 in the expanded state is mounted.

The printer 51 is an example of a recording apparatus and records text, images or the like on the paper sheet which is received in the paper feeding cassette 11. The paper feeding cassette 11, a main body 61, a cover 62, and a carriage 63 are provided in the printer 51. A transport portion (not illustrated) which is used for transporting the paper sheet, an operation panel (not illustrated) which is operated by a user, a controller (not illustrated), which controls the entirety of the printer 51, and the like are provided in the main body 61 of the printer 51, in addition to the cover 62 and the carriage 63. The main body 61 is an example of an apparatus main body. The cover 62 is an example of an intermediate guiding member and a cover. The cover 62 is pivotally mounted to an opening portion which is the opening portion of the main body 61 and to which the paper feeding cassette 11 is mounted. When the paper feeding cassette 11 is mounted to the main body 61, the cover 62 covers the opening portion 23 of the paper feeding cassette 11.

The carriage 63 includes a recording head (described below) which prints text or images on the paper sheet using ink or the like. When recording is performed, the carriage 63 moves in the X-axis direction by receiving power from, for example, a motor (not shown).

When not using the printer 51, for example, the state of the paper feeding cassette 11 is switched to the received state, and then the paper feeding cassette 11 in the received state is mounted to the printer 51, as illustrated in FIG. 4. When using the printer 51 or filling the paper feeding cassette 11 with the paper sheets, first, the paper feeding cassette 11 in the received state is drawn out from the printer 51, as illustrated in FIG. 5. Then, the state of the drawn paper feeding cassette 11 is switched to the expanded state, as illustrated in FIG. 6.

In other words, the stacker 22 of the paper feeding cassette 11 which is drawn out from the printer 51 is pivoted on the arm portions 32 by a user, and thus the stacker 22 is expanded outside the receiving portion 21 in a state where the support surface 41 is directed upward. Next, the drawer tray 33 is drawn out from the tray main body portion 31 by a user. Subsequently, the expansion tray 34 is pivoted by a user, and thus is expanded from the drawer tray 33. In this case, the tray main body portion 31 is located, by the arm portions 32, at a position spaced apart from the pivot centers. Accordingly, the upper side of the receiving portion 21 is opened in wide manner, and thus the paper sheets can be easily received in the receiving portion 21, as illustrated in FIG. 6.

In a case where the paper sheets are received in the paper feeding cassette 11 and the printer 51 is not used, the state of the paper feeding cassette 11 is returned to the received state and the paper feeding cassette 11 in the received state is mounted to the printer 51, as illustrated in FIG. 4.

When using the printer 51, the paper feeding cassette 11 in the expanded state is mounted to the printer 51, as illustrated in FIG. 7. When the paper feeding cassette 11 is in a mounted state, the paper feeding cassette 11 protrudes from one side surface of the main body 61, which constitutes a periphery of the main body 61. In a part of the paper feeding cassette 11, which protrudes from the one side surface, the opening portion 23 is formed between the receiving portion 21 and stacker 22. The cover 62 which is provided on the main body 61 covers the opening portion 23.

The opening portion 23 is formed between the receiving portion 21 and the stacker 22, and the cover 62 which covers the opening portion 23 is provided on the main body 61. Thus, presence or absence of media in the paper feeding cassette 11 can be easily confirmed through the opening portion 23. Furthermore, the cover 62 is provided on the opening portion 23, and thus foreign matter can be prevented from entering into the opening portion 23.

The recorded paper sheet which is discharged from the main body 61 is supported by the stacker 22 in the expanded state.

Furthermore, when the paper feeding cassette 11 in the expanded state is mounted to the printer 51, a front edge (a front side end portion in the Y-axis direction) of the cover 62 is supported by the support surface 41 of the tray main body portion 31 so as to be lifted upward. Thus, the upper surface 81 of the cover 62 forms a surface inclined obliquely upward toward the front edge side. In other words, when the stacker 22 is in the expanded state, the upper surface 81 of the cover 62 forms a guiding surface for guiding the discharged paper sheet to the stacker 22.

Figure 8:
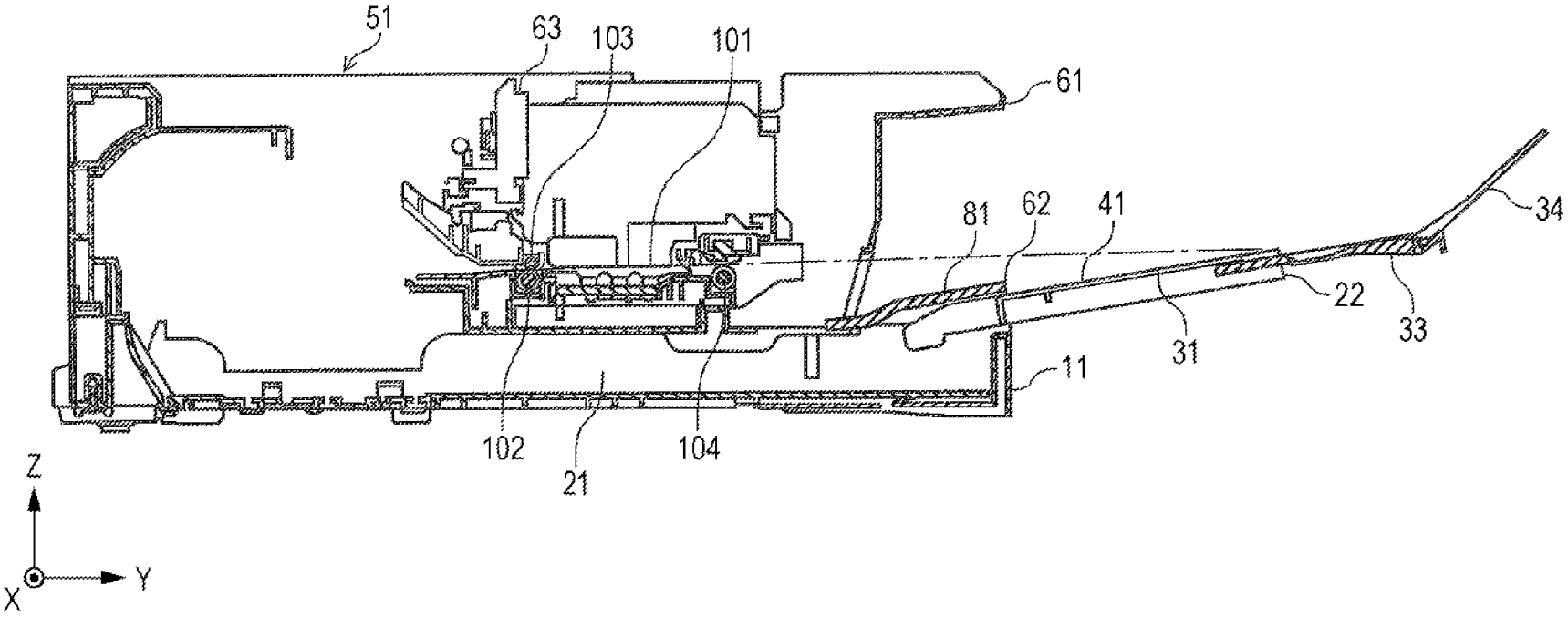
FIG. 8 is a cross-sectional view of a printer according to the invention.

FIG. 8 is a cross-sectional view of the printer 51 in a state where the paper feeding cassette 11 in the expanded state is mounted to the printer 51, taken along a plane formed by the Z axis and Y axis. A recording head 101 is an example of a recording unit and performs recording on the paper sheet. More specifically, the recording head 101 is provided on a bottom surface side of the carriage 63, that is, a side of the paper sheet which is transported by the transporting portion. The recording head 101 prints text or images on the paper sheet using ink or the like. When the paper sheet is transported forward (a right side in FIG. 8) through a sending path, a roller 102 is rotated in a clockwise direction in FIG. 8 by a driving portion (not shown). A roller 103 is disposed to be in contact with the roller 102. When the paper sheet is transported forward through the sending path, the roller 103 is rotated in a counterclockwise direction in FIG. 8 by the roller 102. The roller 102 and the roller 103 pinch the paper sheet and send the paper sheet to the recording head 101 and a roller 104.

When the paper sheet which is subjected to recording by the recording head 101 is transported forward (a right side in FIG. 8), the roller 104 is rotated in the clockwise direction in FIG. 8 by a driving portion (not shown). The roller 104 is disposed to be in contact with a roller (not shown) which faces the roller 104 with the paper sheet pinched by the rollers. The roller 104 and the facing roller pinch the recorded paper sheet and send the paper sheet to the stacker 22 in the expanded state. The stacker 22 in the expanded state supports the transported paper sheet.

A straight line which connects a point at which the paper sheet is pinched by the roller 102 and the roller 103 and a point at which the paper sheet is pinched by the roller 104 and the facing roller intersects with the support surface 41 of the tray main body portion 31 of the stacker 22. Therefore, in a case where recording is performed on a thick paper sheet, when a trailing edge of the paper sheet passes through a portion between the roller 102 and the roller 103, the paper sheet is supported by the roller 104, the facing roller, and the support surface 41 of the tray main body portion 31 of the stacker 22, and thus a distance between the paper sheet and the recording head 101 is maintained. Accordingly, the paper sheet is not in contact with the recording head 101, and thus it is possible to perform recording without deteriorating the recording quality.

Furthermore, when the paper feeding cassette 11 in the expanded state is mounted to the printer 51, the front edge portion of the cover 62 is lifted by the support surface 41. Therefore, the cover 62 forms the guiding surface for guiding the discharged paper sheet to the stacker 22. More specifically, the front edge portion of the cover 62 is lifted by the support surface 41, and thus inclination angles of the upper surface 81 of the cover 62 are set to be the substantially same as inclination angles of the support surface 41 which is inclined obliquely upward. Therefore, the upper surface 81 of the cover 62 and the support surface 41 form a single surface. In other words, when the stacker 22 is in the expanded state, the cover 62 causes the support surface 41 of the stacker 22 to expand to the main body 61 side. When the stacker 22 is in the expanded state, the cover 62 forms the guiding surface for guiding the discharged paper sheet to the stacker 22. Thus, the discharged paper sheet is smoothly supported by the stacker 22.

The cover 62 is pivotally mounted, as described above, and thus the posture of the cover 62 can be changed in accordance with the posture of the stacker 22. The cover 62 is pivotally mounted and the posture of the cover 62 can be changed in accordance with the posture of the stacker 22, and thus it is possible to more smoothly guide the discharged paper sheet to the stacker 22.

Figure 9:
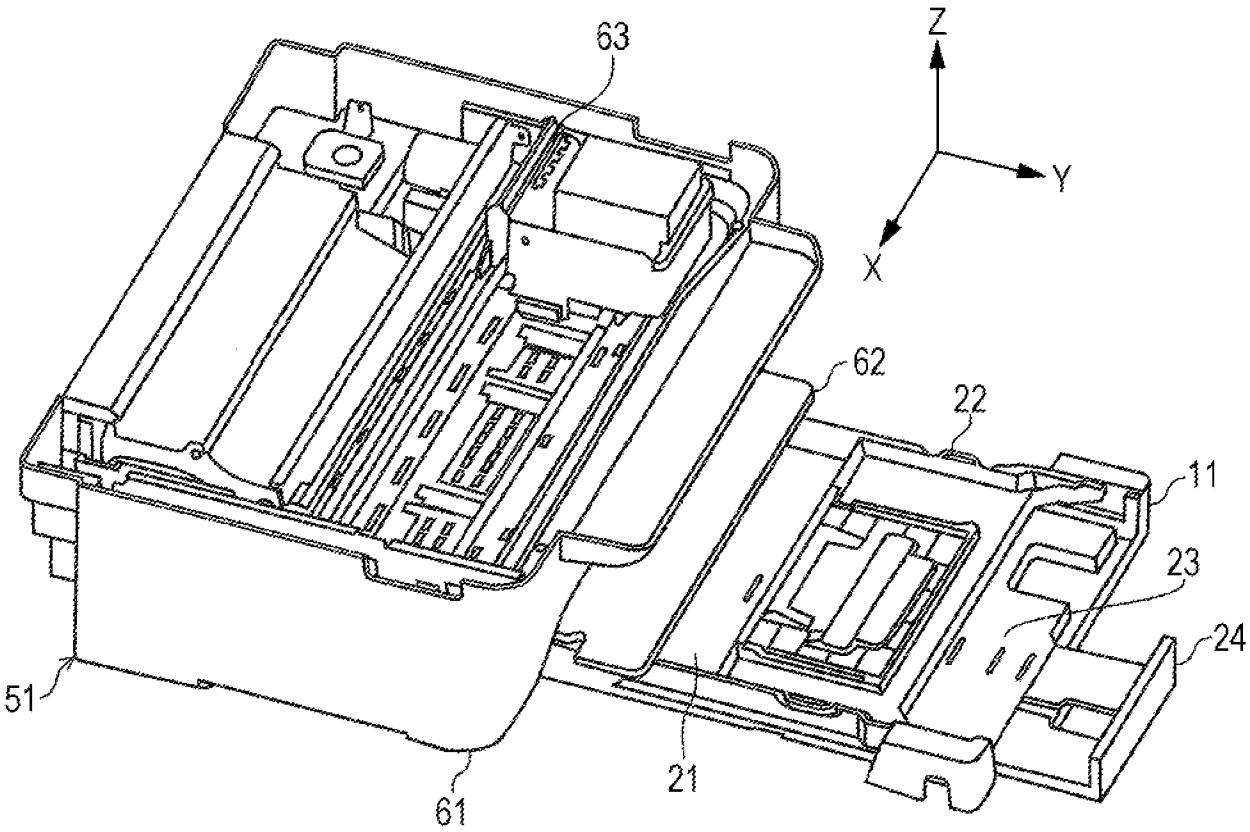
FIG. 9 is a perspective view illustrating a cross-sectional surface and an external appearance of the upper side of the printer according to the invention.

FIG. 9 is a perspective view illustrating a cross-sectional surface and an external appearance of the upper side of the printer 51 in a state where the paper feeding cassette 11 in the received state is drawn out and the drawer portion 24 is drawn forward from the receiving portion 21. When the drawer portion 24 is drawn forward from the receiving portion 21, the opening portion 23 between the receiving portion 21 and the stacker 22 are widened in the Y-axis direction. Thus, it is possible to easily fill the receiving portion 21 with the paper sheets through the opening portion 23. In addition, it is possible to fill the paper feeding cassette 11 with paper sheets having a length longer than a length (a length in the Y-axis direction) of the paper feeding cassette 11.

The printer 51 is applied as an example of a recording apparatus. However, without being limited thereto, a recording apparatus, such as a printing apparatus, a copying machine, a facsimile machine, and other devices may be applied.

As described above, the receiving portion 21 in which the paper sheets are received and the stacker 22 can be provided in the paper feeding cassette 11. In this case, the stacker 22 is pivotally provided on the receiving portion 21 and the state of the stacker 22 can be switched, in a pivoting manner, between the received state in which the stacker 22 is positioned above the receiving portion 21 and the support surface 41 supporting the paper sheet is directed downward and the expanded state in which the support surface 41 is directed upward and at least a part of the support surface 41 is expanded outside the receiving portion 21. The stacker 22 can take a different posture when the state of the stacker 22 is switched between the received state and the expanded state, because the state of the stacker 22 which is provided on the paper feeding cassette 11 can be switched, in a pivoting manner, between the received state in which the stacker 22 is positioned above the receiving portion 21 and the support surface 41 supporting the paper sheet is directed downward and the expanded state in which the support surface 41 is directed upward and the support surface 41 is expanded outside the receiving portion 21. Therefore, the height (the size in a paper-sheet stacking direction) of the paper feeding cassette 11 can be suppressed in the received state. Furthermore, appropriate posture of the stacker 22 in the expanded state can be ensured.

When the stacker 22 is in the expanded state, the support surface 41 can form the surface inclined obliquely upward toward the front edge of the stacker 22. The paper sheet which is discharged from the upper side of the stacker 22 and supported by the support surface 41 can be prevented from slipping off the stacker 22, because, when the stacker 22 is in the expanded state, the support surface 41 forms the surface inclined obliquely upward toward the front edge of the stacker 22. As a result, the paper sheet can be appropriately supported.

The tray main body portion 31 which forms the support surface 41 and the arm portions 32 can be provided in the stacker 22. The arm portions 32 are provided on both end portions of the tray main body portion 31 in the pivot-axis direction of the stacker 22 and extend from the tray main body portion 31 toward the pivot centers of the stacker 22. Furthermore, the arm portions 32 are pivotally connected to the receiving portion 21 and form the pivot centers of the stacker 22. The tray main body portion 31 of the stacker 22 is pivotally mounted to the receiving portion 21 via the arm portions 32 which form the pivot centers. In other words, when the stacker 22 is in the expanded state, the tray main body portion 31 can be located at the position spaced apart from the pivot centers. Accordingly, when the stacker 22 is in the expanded state, the upper portion of the receiving portion 21 can be opened in wide manner, and thus workability is improved when the receiving portion 21 is filled with the paper sheets.

The recording head 101 which performs recording on the paper sheet and the paper feeding cassette 11 which is attachably/detachably mounted to the main body 61 having the recording head 101 are provided in the printer 51, and thus the recorded paper sheet which is discharged from the main body 61 can be supported by the stacker 22 in the expanded state. In this case, it is possible to achieve the same operational effects as those described above.

When the paper feeding cassette 11 is mounted, the paper feeding cassette 11 protrudes from one side surface of the main body 61, which constitutes the periphery of the main body 61. In a part of the paper feeding cassette 11, which protrudes from the one side surface, the opening portion 23 is formed between the receiving portion 21 and stacker 22. In addition, the cover 62 which covers the opening portion 23 can be provided on the main body 61. The opening portion 23 is formed between the receiving portion 21 and the stacker 22, and thus presence or absence of the paper sheets in the paper feeding cassette 11 can be easily confirmed through the opening portion 23. Furthermore, the cover 62 is provided on the opening portion 23, and thus foreign matter can be prevented from entering into the opening portion 23. Although, the cover 62 is provided on the printer main body side, the cover 62 may be provided on the paper feeding cassette 11 side.

The cover 62 is disposed, in the paper-sheet transporting path, between the roller 104 as a discharging roller and the stacker 22 as the medium support tray. When the stacker 22 is in the expanded state, the cover 62 can form the upper surface 81 as the guiding surface for guiding the discharged paper sheet to the stacker 22. The discharged paper sheet is smoothly supported by the stacker 22, because, when the stacker 22 is in the expanded state, the cover 62 functions as the intermediate guiding member and forms the upper surface 81 as the guiding surface for guiding the discharged paper sheet to the stacker 22.

The cover 62 is pivotally mounted, and thus the posture of the cover 62 can be changed in accordance with the posture of the stacker 22. The cover 62 is pivotally mounted and the posture of the cover 62 can be changed in accordance with the posture of the stacker 22, and thus it is possible to more smoothly guide the discharged paper sheet to the stacker 22.

The cover 62 also functions as the intermediate guiding member which forms the guiding surface (the upper surface 81) for guiding the paper sheet to the stacker 22, and thus foreign matter can be prevented from entering into the opening portion 23. In addition, the intermediate guiding member also functions as a cover, and thus it is possible to suppress an increase in costs.

The invention is not limited to the embodiments described above and can be modified in various ways insofar as it does not depart from the scope of the invention described in the claims. Needless to say, the modification examples are also within the scope of the invention.

For example, the paper feeding cassette 11 of the embodiment is attachable/detachable to/from the printer main body. However, the invention can be applied to a configuration in which the paper feeding cassette 11 is provided integrally with the printer main body, that is, the receiving portion 21 for receiving the paper sheets is provided integrally with the printer main body. In this case, the stacker 22 is pivotally provided as in the embodiment described above.

In the embodiment, the stacker 22 in the received state is substantially parallel to a bottom surface of the receiving portion 21 and the stacker 22 in the expanded state is inclined upward. However, the stacker 22 in the received state may be inclined at predetermined angles.

The entire disclosure of Japanese Patent Application No. 2013-091041, filed Apr. 24, 2013 is expressly incorporated by reference herein.

What is claimed is:

1. A recording apparatus comprising:

an apparatus main body;

a recording head which is provided in the apparatus main body, and performs recording on a medium;

a discharging roller that is provided in the apparatus main body, and discharges the medium recorded by the recording head;

an opening portion which is formed in one side surface of the apparatus main body;

an intermediate guiding member that is pivotally mounted to the apparatus main body, and functions as a cover; and a medium receiving cassette which is attachable and detachable, respectively, to and from the opening portion of the apparatus main body and including a cassette opening portion, wherein, when the medium receiving cassette is in an attached state, the medium receiving cassette protrudes from the opening portion of the apparatus main body and the intermediate guiding member covers the cassette opening portion of the medium receiving cassette, wherein the medium receiving cassette further includes a medium receiving portion in which a medium is received, and a medium support tray which is pivotally provided on the medium receiving portion, the cassette opening portion being formed between a part of the medium receiving portion, which protrudes from the one side surface, and the medium support tray, a state of the medium support tray can be switched, in a pivoting manner, between a received state in which the medium support tray is positioned above the medium receiving portion and a medium support surface for supporting the medium is directed downward and an expanded state in which the medium support surface is directed upward and at least a part of the medium support surface is expanded outside the medium receiving portion, wherein the medium discharged by the discharging roller is supported by the medium support tray in the expanded state, wherein the intermediate guiding member is provided between the discharging roller and the medium support tray and which forms a guiding surface for guiding the medium to the medium support tray, and wherein a posture of the intermediate guiding member is changed in accordance with a posture of the medium support tray.

2. The recording apparatus according to claim 1, wherein, when the medium support tray is in the expanded state, the medium support surface forms a surface inclined obliquely upward toward a front edge of the medium support tray.

3. The recording apparatus according to claim 1, wherein the medium support tray includes a tray main body portion which forms the medium support surface, and arm portions which are provided on both end portions of the tray main body portion in the pivot-axis direction of the medium support tray and extend from the tray main body portion toward pivot centers of the medium support tray and which are pivotally connected to the medium receiving portion and form the pivot centers of the medium support tray.

* * * * *